United States Patent [19]

Richter

[11] Patent Number: 4,885,108

[45] Date of Patent: Dec. 5, 1989

[54] METHOD OF SHAPING OF SOAP BAR

[75] Inventor: Stephen P. Richter, Succasunna, N.J.

[73] Assignee: Colgate-Palmolive Company, Piscataway, N.J.

[21] Appl. No.: 160,193

[22] Filed: Feb. 25, 1988

Related U.S. Application Data

[63] Continuation of Ser. No. 895,792, Aug. 12, 1986, abandoned, which is a continuation of Ser. No. 694,534, Jan. 24, 1985, abandoned.

[51] Int. Cl.[4] ..... C11D 17/00

[52] U.S. Cl. ..... 252/134; 252/174; 252/DIG. 16; 249/117; 264/25; 264/26; 264/DIG. 46; 264/DIG. 65; 264/DIG. 66; 264/DIG. 69; 425/174.4; 425/174.8 R; 425/174.8 E; 425/DIG. 46; 425/DIG. 245

[58] Field of Search ..... 252/134, 174, DIG. 16; 264/25, 26, DIG. 13, DIG. 46, DIG. 65, DIG. 66, DIG. 69; 249/117, 160; 425/13, 174.4, 174.8 R, 174.8 E, DIG. 46, DIG. 245

[56] References Cited

U.S. PATENT DOCUMENTS

| | | | |
|---|---|---|---|
| 3,993,722 | 11/1976 | Borcher et al. | 252/134 |
| 4,296,064 | 10/1981 | Satcher | 252/90 |
| 4,481,128 | 7/1984 | Chabinsky | 219/10.55 R |

*Primary Examiner*—Hoa Van Le

*Attorney, Agent, or Firm*—Richard J. Ancel; Murray M. Grill; Robert C. Sullivan

[57] ABSTRACT

A method of shaping a soap bar comprising the steps of obtaining a soap bar, placing the bar in a microwave oven, energizing the oven with sufficient power and time to soften the bar, and forming the softened bar into a desired shape and size.

20 Claims, 2 Drawing Sheets

METHOD OF SHAPING OF SOAP BAR

This is a continuation of application Ser. No. 895,792, filed Aug. 12, 1986, now abandoned, a continuation of Ser. No. 694,534, filed Jan. 24, 1985, now abandonded.

BACKGROUND OF THE INVENTION

The present invention relates to a method of shaping soap bars.

Frequently, a manufacturer of soap products conducts consumer tests during which the soap of the manufacturer is compared by the consumer with the soap of competitors. However, during such tests it is necessary that the consumer is unaware which bar of soap is made by the manufacturer or by the competitors. For this purpose, it is desirable that all of the tested bars have the same size and shape in order that this factor does not influence the test results. In the past, this has been accomplished by chopping up the bars and extruding them into bars of the same shape and size. However, it is believed that this procedure may affect the integrity of the soap, and thus may affect the outcome of the test which is undesirable. Also, this procedure may result in stress cracking of the bars.

SUMMARY OF THE INVENTION

A principal feature of the present invention is the provision of a method of shaping a soap bar in an improved manner.

A method of the present invention comprises the steps of obtaining a soap bar, placing the bar in a microwave oven, and energizing the oven with sufficient power and time to soften the bar.

A feature of the present invention is that the softened bar may be readily formed into a desired shape and size.

Another feature of the invention is that the integrity of the bar is maintained by this procedure.

Still another feature of the invention is that the bar may be formed without stress cracking.

A further feature of the invention is that the bar may be shaved before the placing step in order to eliminate a brand name or obtain a desired contour.

Another feature of the invention is that the bar may be placed in a closed container before the placing step in order to retain moisture and perfume during heating.

Yet another feature of the invention is that the bar may be cooled before the placing step and after the energizing step to enhance the bar luster after formation.

Still another feature of the invention is that the forming step may be simply performed by pressing the bar, such as by in a die or mold.

Further features will become more fully apparent in the following description of the embodiments of this invention and from the appended claims.

DESCRIPTION OF THE PREFERRED EMBODIMENTS

Figure 1:
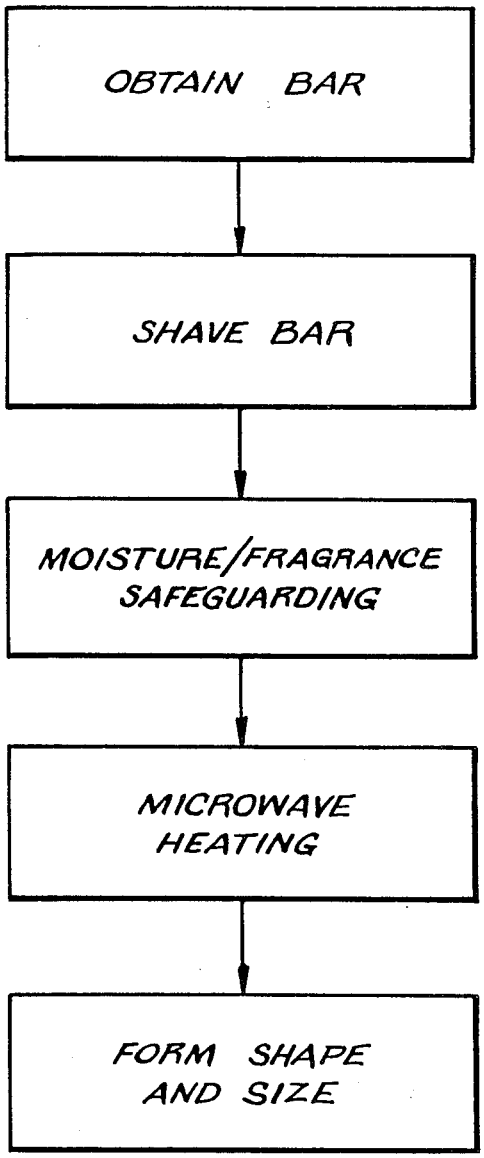
FIG. 1 is a diagrammatic view illustrating a method of shaping a soap bar of the present invention.

Referring now to FIG. 1, there is shown the preferred steps of a method of shaping a soap bar according to the present invention in order to obtain the same shape and size of various soap bars by a manufacturer and its competitors for purposes of a consumer test.

First, as shown, various soap bars of the competitors and manufacturer are obtained which are desired for use in the test. Next, the bars are shaved in order to remove brand names and possibly obtain a desired contour for subsequent use in the dies or molds. The soap bars are then placed in appropriate closed containers utilized for microwave ovens in order to retain moisture and perfume in the bars during subsequent heating of the soap bars.

Figure 2:
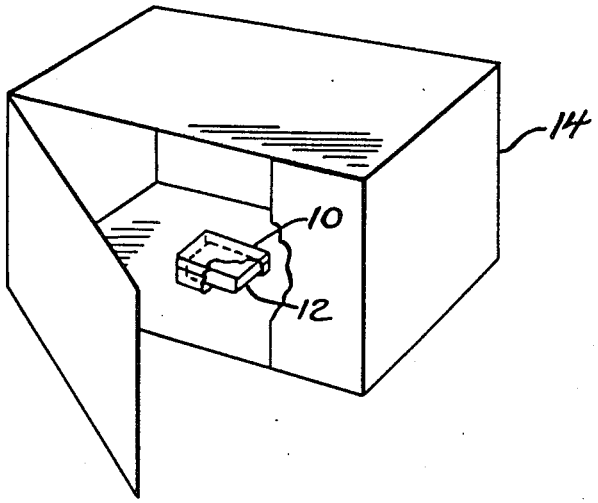
FIG. 2 is a diagrammatic view showing a microwave oven suitable for practicing the method of the invention.

With reference to FIGS. 1 and 2, the closed containers 10 retaining the soap bars 12 are then placed in a microwave oven 14, and the oven is energized in order to heat and soften the bars, thus rendering them flexible. In a preferred form, the bars are heated to approximately 100–120 deg. F., and it is desirable not to overheat the bars such that the heating will not affect the perfume or crack the bars. During this time, the bars are subjected to microwaves comprising an electromagnetic wave which has a wave length between about 0.3 and 30 centimeters, corresponding to frequencies of 1–100 gigahertz which generally is inbetween infrared and radio waves. The bars are subjected to microwaves in the oven with sufficient power and time to soften the bars, or in other words the oven is energized with sufficient power and time to soften the bars. After the bars have been softened, the containers are removed from the microwave oven, and are opened. The softened bars are then formed into a desired shape and size for purposes of the consumer test. In a preferred form, the bars are pressed in a die or mold in order to obtain the desired shape and size. If desired, the bars may also be stamped with a fictitious brand name that is not presently sold on the market such that the consumer will not associate the reformed soap bar with any particular manufacturer. In a preferred procedure, the soap bars are cooled, such as by air conditioning, before and after they are heated in the microwave oven in order to enhance the bar luster after they have been softened and formed.

As a specific example, a single bar of soap named Dove, a trademark of Lever Brothers, was placed in a General Electric microwave oven having a part number JET 2090D2. The oven was energized at a power level of 5 for 30 seconds, and the bar was softened. The softened bar was pressed in order to reform the bar into a desired shape and size.

Thus, in accordance with the method of the present invention various soap bars may be rapidly heated in a microwave oven while the moisture and perfume is retained in the bars during heating and the softened bars are subsequently formed into a desired shape and size for consumer testing.

The foregoing detailed description is given for clearness of understanding only, and no unnecessary limitations should be understood therefrom, as modifications will be obvious to those skilled in the art.

I claim:

1. A method of shaping a soap bar comprising the steps of:

obtaining a soap bar;

placing the bar into a closed container;

subjecting the bar to microwaves with sufficient power and time to soften the bar; and forming the softened bar into a desired shape and size.

2. The method of claim 1 including the step before the subjecting step of shaving the bar to eliminate a brand name.

3. The method of claim 1 including the step before the subjecting step of shaving the bar to obtain a desired contour.

4. The method of claim 1 including the step of retaining moisture in the bar during the subjecting step.

5. The method of claim 1 including the step of retaining perfume in the bar during the subjecting step.

6. The method of claim 1 wherein the bar is heated to 100–120 deg. F. during the subjecting step.

7. The method of claim 1 including the step of cooling the bar prior to the subjecting step.

8. The method of claim 1 including the step of cooling the bar after the subjecting step.

9. The method of claim 1 wherein the forming step comprises the step of pressing the bar.

10. The method of claim 1 wherein the subjecting step comprises the step of softening the bar without turning the bar completely into a liquid.

11. A method of shaping a soap bar comprising the steps of:

obtaining a soap bar;

placing the bar into a closed container;

placing the bar in a microwave oven;

energizing the oven with sufficient power and time to soften the bar; and forming the softened bar into a desired shape and size.

12. The method of claim 11 including the step before the placing step of shaving the bar to eliminate a brand name.

13. The method of claim 11 including the step before the placing step of shaving the bar to obtain a desired contour.

14. The method of claim 11 including the step of retaining moisture in the bar during the energizing step.

15. The method of claim 11 including the step of retaining perfume in the bar during the energizing step.

16. The method of claim 11 wherein the bar is heated to 100–120 deg. F. during the energizing step.

17. The method of claim 11 including the step of cooling the bar prior to the placing step.

18. The method of claim 11 including the step of cooling the bar after the energizing step.

19. The method of claim 11 wherein the forming step comprises the step of pressing the bar.

20. The method of claim 11 wherein the energizing step comprises the step of softening the bar without turning the bar completely into a liquid.

* * * * *